US005768838A

United States Patent [19]

Georgeau

[11] Patent Number: 5,768,838

[45] Date of Patent: Jun. 23, 1998

[54] POLYURETHANE PITCH POCKET

[75] Inventor: Philip C. Georgeau, Kalamazoo, Mich.

[73] Assignee: Consul Tech, Inc., Kalamazoo, Mich.

[21] Appl. No.: 804,497

[22] Filed: Feb. 21, 1997

[51] Int. Cl.[6] ..... E04D 13/14

[52] U.S. Cl. ..... 52/219; 52/60; 52/741.4; 52/742.13

[58] Field of Search ..... 52/58–60, 219, 52/716.2, 717.05, 102, 716.3, 716.4, 741.4, 742.3; 47/23, 33; D25/38, 119

[56] References Cited

U.S. PATENT DOCUMENTS

| | | | |
|---|---|---|---|
| 515,153 | 2/1894 | Miller . | |
| 1,494,234 | 5/1924 | Gossett . | |
| 3,708,185 | 1/1973 | Bilicki et al. . | |
| 3,838,544 | 10/1974 | Hindall | 52/60 |
| 4,031,676 | 6/1977 | Dally | 52/102 |
| 4,635,409 | 1/1987 | Vandemore | 52/60 |
| 4,730,421 | 3/1988 | Leeland . | |
| 4,928,443 | 5/1990 | Goodman et al. | 52/58 |
| 4,934,093 | 6/1990 | Yanna | 52/102 X |
| 4,934,117 | 6/1990 | Barksdale | 52/219 |
| 4,937,991 | 7/1990 | Orth . | |
| 5,493,827 | 2/1996 | Georgeau et al. | 52/219 |

OTHER PUBLICATIONS

Exhibit C is a portion of the National Roofing Contractors Association (NRCA) Roofing and Waterproofing Manual—Fourth Edition (publication date unknown) showing prior flashing and penetration pockets.

Exhibit D is an article from the Roofer Magazine/Jul. '97 showing use of a pitch pocket with a cementatious curb to solve a long–felt need for a product to seal penetrations in built–up asphalt roofing.

Exhibit E is Hawley's Condensed Chemical Dictionary/Eleventh Edition.

Exhibit F is the Guide for the Preparation of Patent Drawings, Oct., 1993.

Exhibit A is a prior art pitch pocket having a cementatious curb for use with built–up asphalt roofing systems.

Exhibit B is a portion of the 1997 Modern Plastics Encyclopedia.

*Primary Examiner*—Robert Canfield
*Attorney, Agent, or Firm*—Price, Heneveld, Cooper, DeWitt & Litton

[57] ABSTRACT

A pitch pocket includes a multi-piece curb that has at least four quarter-circular corner elements, and at least four intermediate elements. Each of the curb elements has a base surface and similarly shaped lateral cross-sectional configuration with diagonal cut free ends. When the diagonal cut free ends are arranged abuttingly end-to-end, the elements define a continuous pocket with a generally quadrilateral plan shape. An adhesive is applied to the base surface and the free ends of each of the curb elements to secure the curb elements to each other and to the roof. A pourable sealant is cast within the pocket and forms a solid seal about the penetration in the roof. The curb elements are preferably made from a thermosetting polyurethane material.

12 Claims, 3 Drawing Sheets

POLYURETHANE PITCH POCKET

CROSS-REFERENCES TO RELATED APPLICATIONS

The present application is related to commonly assigned, issued U.S. Pat. 5,493,827 entitled PITCH POCKET, which is hereby incorporated by reference.

BACKGROUND OF THE INVENTION

The invention relates to a pitch pocket or pan for sealing mechanical penetrations in a waterproof membrane covering a roof substrate, and in particular to a pitch pocket having a curb made from a thermosetting polymer, the curb being configurable to a wide variety of shapes and sizes, including large quadrilateral penetrations.

In a typical low slope, single-ply membrane roof, provision must be made for sealing penetrations of the roof by vent pipes, support straps, conduits, guy anchors and similar elements. Larger structural members such as H-beams may also penetrate a roof, requiring a sealed joint. Generally, a pitch pocket or pan which surrounds the penetrating element is used. A sealant is poured into the pan around the penetrating element. Various types of pitch pockets or pans have been proposed. Examples may be found in U.S. Pat. 3,838,544 entitled Adjustable Pitch Pocket Structure, which issued on Oct. 1, 1974, to Hindall; U.S. Pat. 4,928,443 entitled Pourable Sealer Pocket, which issued on May 29, 1990, to Goodman et al.; U.S. Pat. 4,934,117 entitled Pitch Pocket And Method Of Forming Same, which issued on Jun. 19, 1990, to Barksdale; and U.S. Pat. 4,937,991 entitled Flashing Unit For Sealing Roof Penetrations, which issued on Jul. 3, 1990, to Orth.

In one approach, a prefabricated angle iron flange, at least two inches deep, is fabricated remote from the job site. The flange is bonded to the roofing membrane with a solvent-based contact cement, thus forming a metal dam around the roof penetration. Sheet rubber flashing is applied to the outer surfaces of the flange with contact cement to prevent rusting and corrosion. The perimeter of the applied rubber flashing is then sealed with a bead of solvent-based rubber caulking to keep it from being underridden by water. A two-part urethane rubber pourable sealant is mixed and poured into the cavity until it is level with the top of the metal flange. The liquid rubber cures to form a solid rubber seal around the roof penetration.

The installation of available pitch pans is time consuming, complicated and expensive. The process generally takes about 45 minutes per unit and is quite labor intensive. The complexity of the procedure under field conditions has caused errors in workmanship and improper installations, leading to failure of the seal formed by the pitch pan. Because of the time and expense associated with traditional pitch pans, many contractors have compensated by filling the pan cavity with sand, mortar or urethane foam and covering the top surface with caulk to give the appearance of a solid rubber seal. These practices have led to frequent leaks and failures that make traditional pitch pans unreliable. Therefore, a need exists for a pitch pocket and installation method which simplifies field application, reduces the cost of materials and is easily adapted to provide for a variety of shapes and sizes of penetrating elements including larger rectangular penetrations while providing a reliable waterproof seal between a roof membrane and penetration therein. In addition, a need exists for a curb for a pitch pocket that is made from a heat resistant, lightweight polymer material that is durable and easily shipped to the installation site.

SUMMARY OF THE PRESENT INVENTION

One aspect of the present invention is to provide a pitch pocket for sealing a mechanical penetration of a roof. The pitch pocket includes a multi-piece curb that has at least four quarter-circular corner elements, and at least four intermediate elements. Each of the curb elements has a base surface and similarly shaped lateral cross-sectional configuration with diagonal cut free ends. When the diagonal cut free ends are arranged abuttingly end-to-end, the elements define a continuous pocket with a generally quadrilateral plan shape. An adhesive is applied to the base surface and the free ends of each of the curb elements to secure the curb elements to each other and to the roof. A pourable sealant is cast within the pocket and forms a solid seal about the penetration in the roof.

Another aspect of the present invention is to provide a kit for sealing mechanical penetrations in a roof. The kit includes a plurality of straight pocket elements that have a generally linear plan configuration, a base surface, an upstanding sidewall with a predetermined lateral cross-sectional shape and diagonally cut free ends. The kit also includes a plurality of end pocket elements that have a generally semi-circular plan configuration, a base surface and an upstanding sidewall with a predetermined lateral cross-sectional shape that is substantially identical to the cross-sectional shape of the straight pocket elements. The end pocket elements also have diagonally cut free ends that are shaped to mate flush with the free ends of the straight pocket elements. The kit also includes a plurality of corner pocket elements that have a generally quarter-circular plan configuration, a base surface and an upstanding sidewall with a predetermined lateral cross-sectional shape that is substantially identical to the lateral cross-sectional shape of the straight pocket elements and the end pocket elements. The corner pocket elements have diagonally cut free ends that are shaped to mate flush with the free ends of the straight pocket elements and the end pocket elements. The straight, semi-circular and quarter-circular pocket elements are adapted to be positioned end-to-end in a circular, rectangular, square, oblong and other similar patterns to define similarly shaped pockets about the roof penetration. The kit also includes adhesive that is adapted to be applied to the base surfaces and free ends of the selected pocket elements to secure the same to each other and to the roof in the form of the selected pocket shape. A pourable sealant that is adapted to be cast within the selected shaped pocket and thereby form a solid seal about the roof penetration is also included in the kit.

Another aspect of the present invention is a curb for a pitch pocket. The curb includes at least four quarter-circular corner elements, and at least four intermediate elements. Each of the curb elements is made of an organic material and defines joint surfaces, inner peripheral surfaces, base surfaces and tapered outer surfaces. The joint surfaces are adapted to receive an adhesive for joining the curb elements together to define a pocket when in an assembled condition. The corner elements are also adapted to receive a cast sealant within the pocket when in an assembled condition.

The principal objects of the present invention are to provide a pitch pocket for sealing a mechanical penetration of a roof. The pitch pocket includes a multi-piece curb that is adhesively bonded together, and is also bonded to the roof surface. A pourable sealant is cast within the pocket to seal the roof penetration. The curb elements may be formed of a thermosetting polymer material that is durable and easily shipped. The cross-sectional configuration of the curb resists ice damage, further contributing to the durability of the pitch pocket. The present pitch pocket is easily adapted to seal a mechanical penetration of a roof by a variety of beams, pipes or other such mechanical penetrations of various sizes and shapes.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
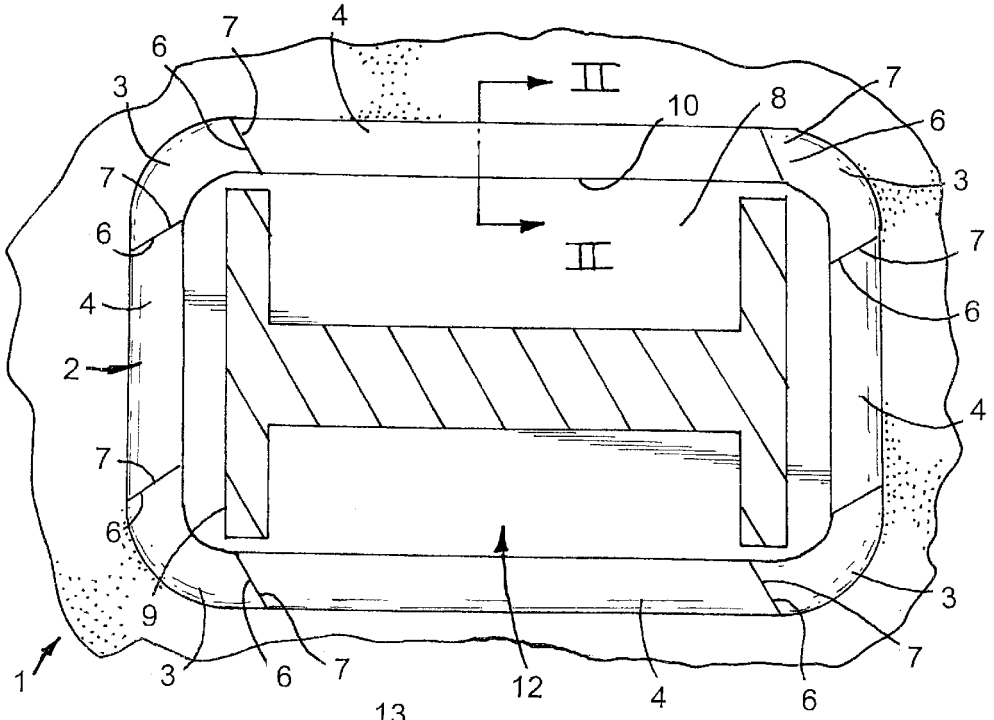
FIG. 1 is a top plan view of a pitch pocket in accordance with the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a pitch pocket embodying the present invention, which is particularly designed for sealing a mechanical penetration of a roof. In the illustrated example, pitch pocket 1 includes a multi-piece curb 2 having at least four quarter-circular corner elements 3, and at least four intermediate elements 4. Each of the curb elements has a base surface 5 and similarly shaped lateral cross-sectional configuration with diagonal cut free ends 6 which define a continuous pocket when arranged abuttingly end-to-end with a generally quadrilateral plan shape. An adhesive 7 is applied to the base surface 5 and the free ends 6 of each curb element for securing the curb elements to each other and to the roof. A pourable sealant 8 is cast within the pocket and forms a solid seal about the penetration such as an H-beam 9, in the roof. Each of the curb elements is preferably made from a substantially solid thermosetting polyurethane material that is durable and easily shipped to the installation site.

Figure 2:
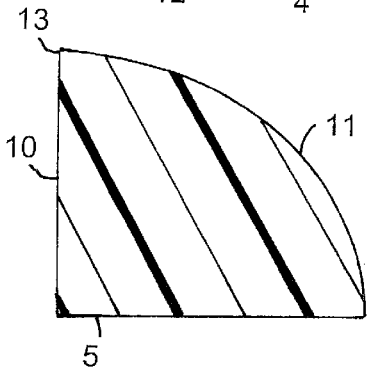
FIG. 2 is a cross-sectional view taken generally along the lines II–II of FIG. 1.

The intermediate or straight elements 4 are available in various lengths to be used with a variety of quadrilateral or rectangular shaped roof penetrations such as the H-beam illustrated in FIG. 1. Each of the curb elements has a substantially identical cross-sectional shape. (FIG. 2). The base surface 5 is substantially flat, and is bonded to the roof surface by adhesive 7. The inner peripheral surface 10 is substantially orthogonal to the base surface 5, and forms a pocket 12 for receiving the pourable cast sealant 8. A tapered outer surface 11 preferably forms a convex curved surface and helps deflect ice upward, preventing excessive horizontal force on the pitch pocket. Each of the curb elements has diagonal cut free ends 6 which provide an increased surface area for bonding the curb elements together with adhesive 7. Although the free ends could have a variety of configurations, a substantially flat surface is preferred for simplicity of installation. As illustrated in FIG. 1, the diagonal cut free ends 6 of each curb element are oriented in a similar manner such that each intermediate or straight element 4 is compatible with each corner element 3.

Figure 5:
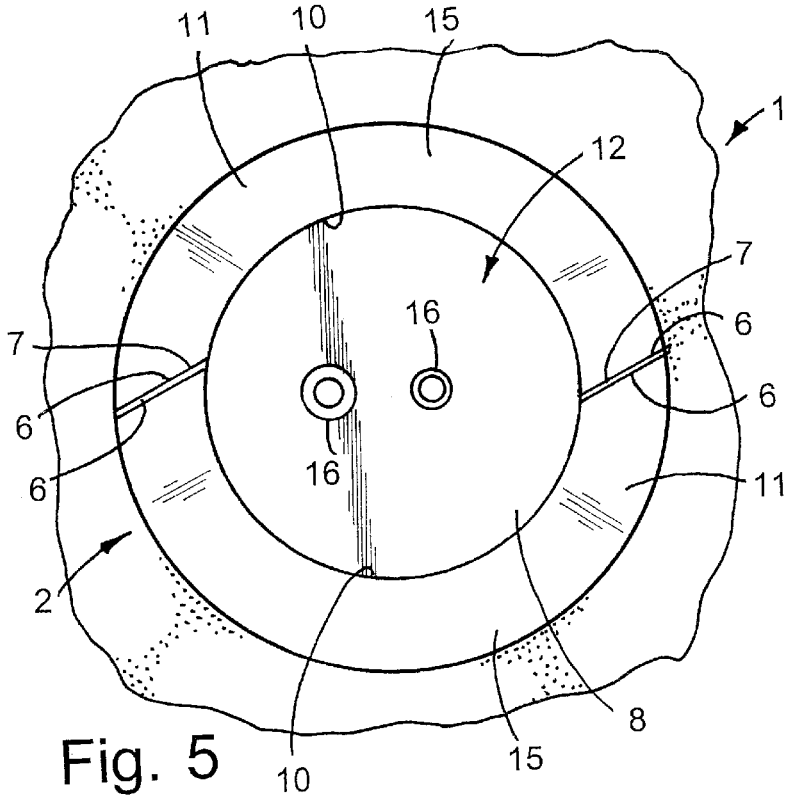
FIG. 5 is a top plan view of a circular pitch pocket in accordance with the present invention.
Figure 6:
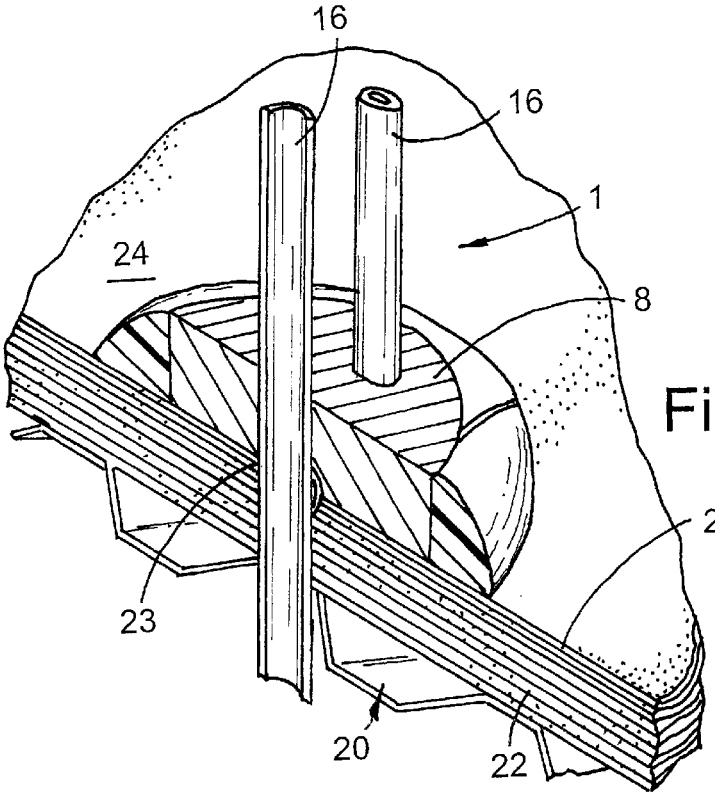
FIG. 6 is a cross-sectional view taken generally along the lines VI–VI of FIG. 7.
Figure 7:
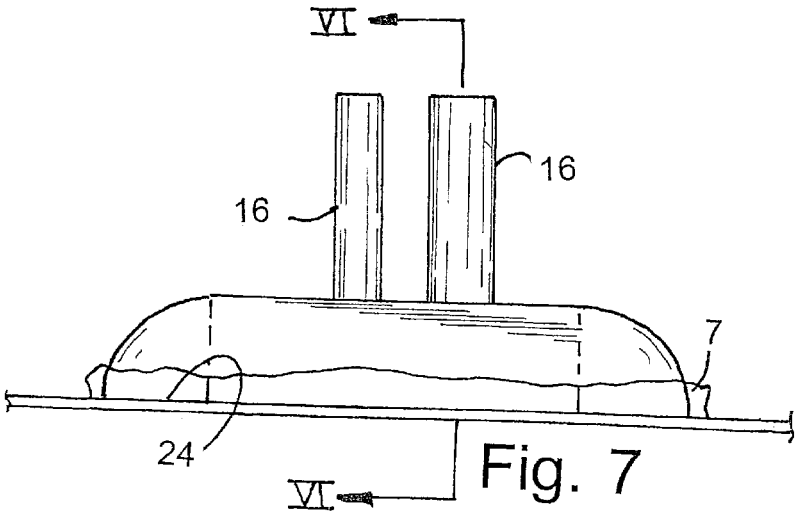
FIG. 7 is a side, elevational view of the pitch pocket of FIG. 5.

With reference to FIGS. 5 and 6, an alternative embodiment of the present pitch pocket 1 includes a pair of semi-circular end pocket or curb elements 15. Each of the semicircular end pocket elements 15 has diagonal cut free ends 6 having a substantially flat surface. An inner peripheral surface 10 and a tapered, convex curved outer surface 11 form a pocket 12 for receiving the pourable cast sealant 8 in a manner similar to that described above. Adhesive 7 is applied to the diagonal cut free ends 6 and the base surface 5 to bond the curb elements to the roof surface and also to the adjacent pocket element 15. The ring shape of the curb, illustrated in FIG. 5, reduces the quantity of sealant 8 that is required to fill the pocket when used for circular or smaller penetrations such as the pipe 16.

Figure 3:
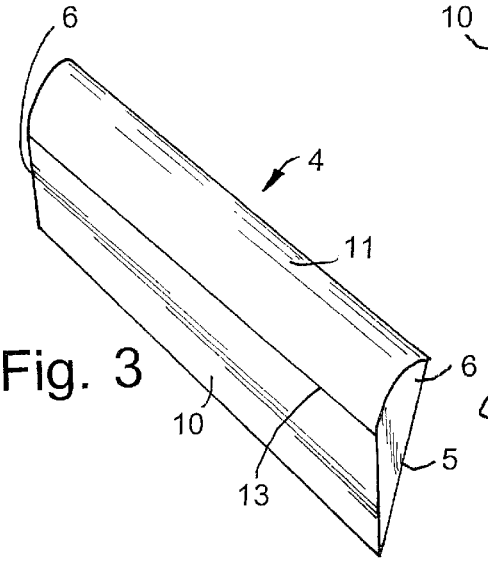
FIG. 3 is a perspective view of an intermediate curb element.
Figure 4:
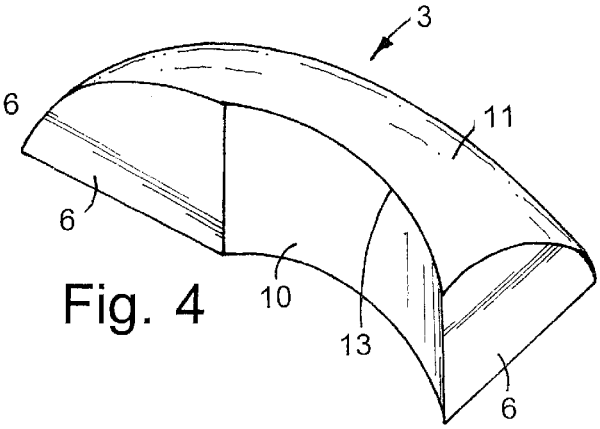
FIG. 4 is a perspective view of a quarter-circular corner curb element.
Figure 8:
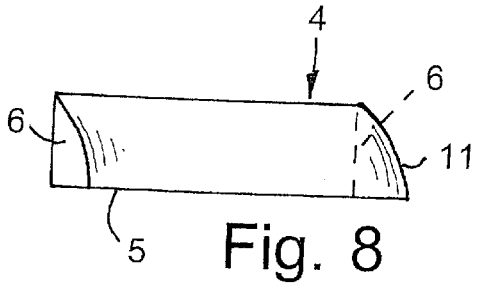
FIG. 8 is a side elevational view of an intermediate curb element which may be used in a pitch pocket.
Figure 9:
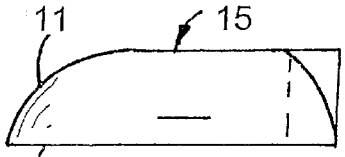
FIG. 9 is a side elevational view of a semi-circular curb element incorporated in the pitch pocket of FIG. 5.
Figure 10:
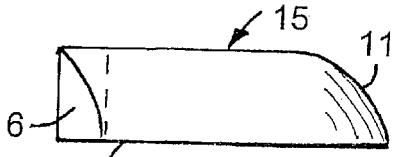
FIG. 10 is a side elevational view of another semi-circular curb element incorporated in the pitch pocket.

Semi-circular end pockets or curb elements 15 can form the ends of an elongated pitch pocket formed by inserting a pair of intermediate, straight elements 4 (FIGS. 3, 8). The diagonal cut free ends 6 of the intermediate elements 4 are substantially flat and receive adhesive 7 to abut with the diagonal cut free ends 6 of the semi-circular pocket elements 15. Various length intermediate elements 4 can be utilized to adjust the pocket size as required to accommodate larger or smaller penetrations.

Individual curb elements 3, 4 and 15 are molded from a heat resistant polyurethane material that is durable and easily shipped without breakage. Prior cementitious curb elements were impervious to corrosion and provided a low cost construction. However, it is desirable to provide a material that is lightweight and durable to withstand the temperature extremes of a roof environment. In addition, it is desirable to provide a lightweight material having improved durability for shipping purposes.

In a presently existing embodiment, the curb has a width "w" of 2 inches, a height "h" of 2 inches and an outer diameter of 11.5 inches. It is presently preferred that the height be at least 2 inches. When filled with sealant, the curb raises the point of entry of the roof penetration the same height above the roof line and away from standing water. Quarter-circular corner elements and intermediate, straight elements of various sizes can be utilized to accommodate a wide range of roof penetrations, including larger, rectangular structural penetrations.

A typical installation in accordance with the present invention is illustrated in FIGS. 1, 5–7. As shown, the pitch pocket 1 is installed on a roof substrate which includes a steel deck 20. Deck 20 is covered by sheets of insulation 22. A waterproof membrane 21 is applied to the roof over the insulation 22. Pipes or other penetrations 16 extend through the steel deck 20, insulation 22 and the waterproof rubber membrane 21. Membrane 21 is cut at 23 to allow the penetrating member to pass through. The membrane is then bonded in place to insulation 22, leaving small flaps projecting up around the penetration and, hence, into the pan. Gaps between the penetration in adjacent material are sealed with adhesive. The adhesive prevents liquid sealant from draining out of the pan through cut membrane. Pitch pocket 1 provides a durable and lasting waterproof seal at the penetration in the membrane 21. To install the pitch pocket in accordance with the present invention, individual elements 3, 4 and/or 15 are positioned around the penetration. Adhesive 7 is applied to the joint surfaces 6 and the base surfaces 5. The separate curb elements allow assembly of the pocket about a pipe system or other penetration wherein the end of the penetration is not accessible. Elements 3, 4 are joined to form a single curb, and the curb is secured on upper surface 24 of the membrane 21. The adhesive seals the joints defined by the elements and firmly secures the curb to the membrane. A bead of adhesive may also be applied around the periphery of the curb. Next, sealant 8 is poured into pocket 12 defined by the curb. The pocket is filled to the upper edge 13 of the curb. It is presently preferred that a two-part pourable urethane sealant be mixed and poured into the pocket. Such a sealant sets in approximately 2 hours to form a solid composite seal with the perimeter or inner surface 10 of the curb.

The curb raises the point of entry of the penetration through the roof two or more inches above the roof surface 24 and away from standing water. The tapered or curved outer surface 11 keeps ice from pushing in on the pitch pocket. The curb provides support and protection for the rubber sealant contained within the pocket. The pitch pocket may be installed in less than 15 minutes. Due to its simplicity, the system minimizes errors in workmanship and reduces costs while providing an improved and permanent seal around penetrations in the roof membrane. The polyurethane material that forms the curb elements is relatively lightweight, durable and is easily shipped to the installation site without breakage.

It is presently preferred that adhesive 7 applied to the joint surfaces, the under surface of the curb elements and around the periphery be a cartridge grade, moisture-curing, mastic adhesive. The adhesively joined curb elements 3, 4 or 15 obtain sufficient strength to maintain their position within 5 to 10 minutes after being moved into an abutting relationship. Adhesive used in bonding the polyurethane components to each other and to the roof membrane are well known in the art. Adhesives which have been found to be effective are Polymeric Systems silicone 635 and 641. In addition, Dow Corning silicone 799 and Chem Rex urethane NP-1 adhesives are effective bonding agents. Uniroyal 6329 solvent-based EPDM sealant will provide good adhesion to single-ply membranes. The Uniroyal EPDM sealant is, however, the least preferred because of its slow set time period.

The pitch pocket in accordance with the present invention readily forms seals around penetrations and roofing materials. The quarter-circular corner elements 3 in conjunction with elongated or straight elements 4 coordinate the geometry of the pitch pan to form elongated and rectangular pitch pans for various penetrations, including large structural penetrations such as the illustrated H-beam. The polyurethane curb and containment system will not corrode or deteriorate in rooftop environments. In addition, the polyurethane material is durable, relatively lightweight and easily shipped to the installation site. Separate rubber flashing on the exterior surface of the curb is not needed to protect it from the elements. Efficient pitch pan assembly is achieved which substantially reduces the time and labor involved in installation. A circular geometric form can be used for circular or smaller penetrations thereby using less pourable rubber sealant to seal an equivalent penetration member. In addition, the pitch pan is aesthetically pleasing due to its rounded shoulders and more streamlined appearance over the sheet metal pitch pans presently used.

Although the joint surfaces have been described and shown as being substantially flat and smooth, they may be textured (i.e., serrated) so as to mechanically interengage with an adjacent joint surface thereby increasing the joint surface and joint integrity. Further, although the above embodiments have been described as using an adhesive as joining means to bond and seal the joints between adjacent curb elements, such joining means may also be implemented by utilizing a tongue and groove, keyed or other form of interlocking structure on adjacent joint surfaces without using adhesive. Alternatively, the joining means may comprise a combination of such mechanical interlocking structure and adhesive.

In view of the above description, those of ordinary skill in the art may envision various modifications which would not depart from the event of concepts disclosed herein. For example, the pitch pocket is usable with built up asphalt roofing and cement and metal roof structures in addition to the illustrated EPDM membrane roof. The above description should, therefore, be considered as only that of the preferred embodiments. The true spirit and scope of the present invention may be determined by reference to the appended claims.

The embodiments of the invention in which an exclusive property or privilege is claimed are defined as follows:

1. A pitch pocket for sealing a mechanical penetration of a roof, comprising:

a multi-piece curb, having at least four quarter-circular corner elements, and at least four intermediate elements, wherein each of said curb elements is made from a substantially solid polyurethane material and has a base surface and similarly shaped lateral cross-sectional configuration with diagonal cut free ends which when arranged abuttingly end-to-end define a continuous pocket with a generally quadrilateral plan shape;

an adhesive applied to the base surface and the free ends of each of said curb element for securing the curb elements to each other, and to the roof; and a pourable sealant cast within said pocket and forming a solid seal about the penetration in the roof.

2. A pitch pocket as set forth in claim 1, wherein:

said curb elements each include an inner peripheral surface substantially orthogonal to said base surface defining an upper edge, said base surface defining an outer peripheral edge, each of said curb elements defining a curved outer surface extending from said upper edge of said inner peripheral surface to said outer peripheral edge of said base surface.

3. A pitch pocket as set forth in claim 2, wherein:

at least one of said intermediate elements is straight.

4. A pitch pocket as set forth in claim 3, wherein:

each of said intermediate elements is straight, such that said pocket has a generally rectangular plan shape.

5. A pitch pocket as set forth in claim 4, wherein said diagonal cut free ends are substantially flat.

6. A pitch pocket as set forth in claim 5, wherein said adhesive is a cartridge grade, moisture-curing, mastic adhesive.

7. A pitch pocket as set forth in claim 6, wherein each of said curb elements has a substantially solid cross section.

8. A kit for sealing mechanical penetrations in a roof, comprising:

a plurality of straight pocket elements made from a substantially solid polyurethane material and each having a generally linear plan configuration, a base surface, an upstanding sidewall with a predetermined lateral cross-sectional shape, and diagonally cut free ends;

a plurality of end pocket elements made from a substantially solid polyurethane material and each having a generally semi-circular plan configuration, a base surface, an upstanding sidewall with a predetermined lateral cross-sectional shape that is substantially identical to the lateral cross-sectional shape of said straight pocket elements, and diagonally cut free ends shaped to mate flush with the free ends of said straight pocket elements;

a plurality of corner pocket elements made from a substantially solid polyurethane material and each having a generally quarter-circular plan configuration, a base surface, an upstanding sidewall with a predetermined lateral cross-sectional shape that is substantially identical to the lateral cross-sectional shape of said straight pocket elements and said end pocket elements, and diagonally cut free ends shaped to mate flush with the free ends of said straight pocket elements and said end pocket elements, such that selected ones of said straight, semi-circular and quarter-circular pocket elements are adapted to be positioned end-to-end in circular, rectangular, square, oblong, and other similar patterns to define similarly shaped pockets about the roof penetration;

adhesive adapted to be applied to the base surfaces and free ends of said selected pocket elements to secure the same to each other and to the roof in the form of the selected pocket shape; and a pourable sealant adapted to be cast within the selected shaped pocket, and thereby form a solid seal about the roof penetration.

9. A kit for sealing mechanical penetrations in a roof as set forth in claim 8, wherein:

said pocket elements include inner peripheral surfaces and tapered outer surfaces.

10. A kit for sealing mechanical penetrations in a roof as set forth in claim 9, wherein:

said tapered outer surface defines a convex curve.

11. In a roof construction for a building of the type having a planar steel deck defining an upper surface with an aperture therethrough, a waterproof rubber membrane extending over and abuttingly supported by said upper surface, and having an aperture therethrough, and a structural beam extending through said aperture in said steel deck and said aperture in said membrane; the improvement comprising:

a curb member made from substantially solid polyurethane and including at least four quarter-circular elements and at least four intermediate elements, wherein each of said curb elements has a substantially flat base surface with an outer peripheral edge, an inner peripheral surface disposed substantially orthogonal to said base surface and defining an upper edge, and a curved outer surface extending from said upper edge of said inner peripheral surface to said outer peripheral edge of said base surface, said curb elements having substantially flat diagonal cut free ends arranged abuttingly end-to-end defining a quadrilateral plan shape with said structural beam extending therethrough;

an adhesive applied to said base surfaces and to said diagonal cut free ends securing said curb elements to one another and to said waterproof rubber membrane;

a pourable sealant cast within said pocket and forming a solid seal around said beam.

12. A method of sealing a relatively large structural penetration in a roof of the type having a waterproof rubber membrane, comprising:

providing a multi-piece curb made from a polyurethane material and having at least four quarter-circular corner elements, and at least four intermediate elements, wherein each of said curb elements has a base surface and similarly shaped lateral cross-sectional configuration;

cutting the membrane to allow the structural penetration to pass through the membrane;

adhesively sealing the membrane to the penetration;

diagonally cutting the ends of the curb elements;

applying adhesive to the diagonal cut free ends and to the base surface of the curb elements;

arranging the curb elements around the penetration with the base surface of the curb elements abutting the membrane, and the free ends of the curb elements abuttingly end-to-end to define a continuous pocket with a generally quadrilateral plan shape; and pouring a hardening sealant into the pocket.

* * * * *

UNITED STATES PATENT AND TRADEMARK OFFICE

CERTIFICATE OF CORRECTION

PATENT NO. : 5,768,838
DATED : June 23, 1998
INVENTOR(S) : Philip C. Georgeau

It is certified that error appears in the above-identified patent and that said Letters Patent is hereby corrected as shown below:

Column 8, claim 12, lines 45 & 47;

"base surface" should be --base surfaces--.

Signed and Sealed this

Fifteenth Day of December, 1998

Bruce Lehman

*Attest:*

BRUCE LEHMAN

*Attesting Officer*

*Commissioner of Patents and Trademarks*